United States Patent [19]

Yasuoka et al.

[11] Patent Number: 4,702,210

[45] Date of Patent: Oct. 27, 1987

[54] APPARATUS FOR CONTROLLING IDLING ROTATION NUMBER OF INTERNAL COMBUSTION ENGINE

[75] Inventors: Akimasa Yasuoka; Takeo Kiuchi, both of Tokyo, Japan

[73] Assignee: Honda Giken Kogyo Kabushiki Kaisha, Tokyo, Japan

[21] Appl. No.: 871,738

[22] Filed: Jun. 9, 1986

[30] Foreign Application Priority Data

Jun. 28, 1985 [JP] Japan ..... 60-141848

[51] Int. Cl.[4] ..... F02D 41/16; F02M 3/07

[52] U.S. Cl. ..... 123/339; 123/179 L

[58] Field of Search ..... 123/339, 179 L

[56] References Cited

U.S. PATENT DOCUMENTS 4,444,168 4/1984 Matsumura et al. ..... 123/339

4,469,064 9/1984 Manaka et al. ..... 123/339

FOREIGN PATENT DOCUMENTS 123336 9/1980 Japan ..... 123/339

50243 3/1985 Japan ..... 123/339

*Primary Examiner*—Tony M. Argenbright

*Attorney, Agent, or Firm*—Pollock, Vande Sande and Priddy

[57] ABSTRACT

Feedback control of the opening area of a bypass which is provided in parallel with a throttle valve of an engine is conducted immediately after the cranking is completed, based on the deviation of existing RPM from the target RPM which is memorized as the function of the engine temperature in advance, to maintain the idling RPM of the engine at optimum level in the state of after-cranking without being affected by the possible change in viscosity of engine oil, the variations in temperatures of the ambient air and the engine cooling water, the load of engine, and so on. The control signals for the feedback control are learned when the existing RPM are substantially equal to the target RPM and stored in a memory. One of the learned values is read out for fixing a control signal in the beginning of the state of after-cranking so that the RPM of the engine is smoothly approximated to the target RPM when the engine shifts from the during-cranking state to the idling state.

13 Claims, 18 Drawing Figures

| |
|---|
| FIG. 8A |
| FIG. 8B |

| |
|---|
| FIG. 14A |
| FIG. 14B |

APPARATUS FOR CONTROLLING IDLING ROTATION NUMBER OF INTERNAL COMBUSTION ENGINE

BACKGROUND OF THE INVENTION (1) Field of the Invention

This invention relates to an apparatus for the control of the idling speed of an internal combustion engine, and more particularly relates to an apparatus for the control of the idling speed of the internal combustion engine, capable of controlling the number of rotations of the internal combustion engine during an idling operation following the termination of cranking at the optimum level without being affected by change in viscosity of the engine oil, the temperature of cooling water, the temperature of the ambient air, and the load exerted on the internal combustion engine.

(2) Description of the Prior Art

The internal combustion engine used in an automobile (hereinafter referred to simply as "engine") is provided with a bypass for bypassing a throttle valve and a valve for regulating the amount of air passed through the bypass by varying the area of an opening in the bypass.

Feedback control of the number of engine rotations (RPM) especially during an idling operation of the engine has heretofore been attained by varying the area of an opening in the bypass. To be specific, in starting the cranking and after terminating the cranking, it has been customary that during the period which elapses until a stabilized idling operation is established (hereinafter referred to as "after-cranking"), the feedback control is switched to the open loop control and the area of an opening in the bypass is controlled by the amount of regulation experimentally or empirically determined in advance.

The conventional technique described above has entailed the following problem.

The number of engine rotations in-cranking and after-cranking is controlled by the open loop system using fixed values. When the engine oil is changed to that which has different viscosity or when the load on the engine is varied, therefore, the number of engine rotations during in-cranking and after-cranking becomes highly unstable.

Some grades of engine oil gain in viscosity at lower temperatures. When the engine oil previously used in the engine is changed to one of such grades of engine oil and when the temperature of the ambient air is extremely low at the time that the engine is started, for example, the engine which has been started and set operating by itself may be readily stopped or deprived of stability of rotation after stop of the starter because the amount of air fed through the bypass is insufficient.

Further, there is a possibility that the problem just mentioned will occur even at room temperature when the engine oil is fouled so much as to deteriorate the quality.

SUMMARY OF THE INVENTION

For the solution of the problem, this invention is characterized by being so adapted that as soon as the engine completes the cranking, feedback control will be initiated on the control valve in the bypass by reading out a target number of after-cranking rotations stored in advance, comparing the target number of rotations with the actual number of engine rotations existing at the time, and feeding a control signal corresponding to the outcome of the comparison to a control valve driving means serving to drive the control valve in the bypass.

The present invention, therefor, enables the number of after-cranking engine rotations to be maintained always at an optimum level without being affected by the possible change in viscosity of engine oil and the variations in the temperature of the ambient air, the temperature of the engine cooling water, and the load of engine and, at the same time, improves the consumption of the fuel.

Further, since this invention contemplates learning the control signal mentioned above when the target number of rotations is substantially equal to the actual number of rotations during the period of feedback control and, based on the learned value obtained in consequence of the learning, fixing the control signal at least when the after-cranking starts, the number of engine rotatons can be smoothly approximated to the target number of rotations when the engine shifts from the during-cranking state to the idling state.

DETAILED DESCRIPTION OF THE PREFERRED EMBODIMENTS

Now, the present invention will be described in detail below with reference to the accompanying drawings.

Figure 2:
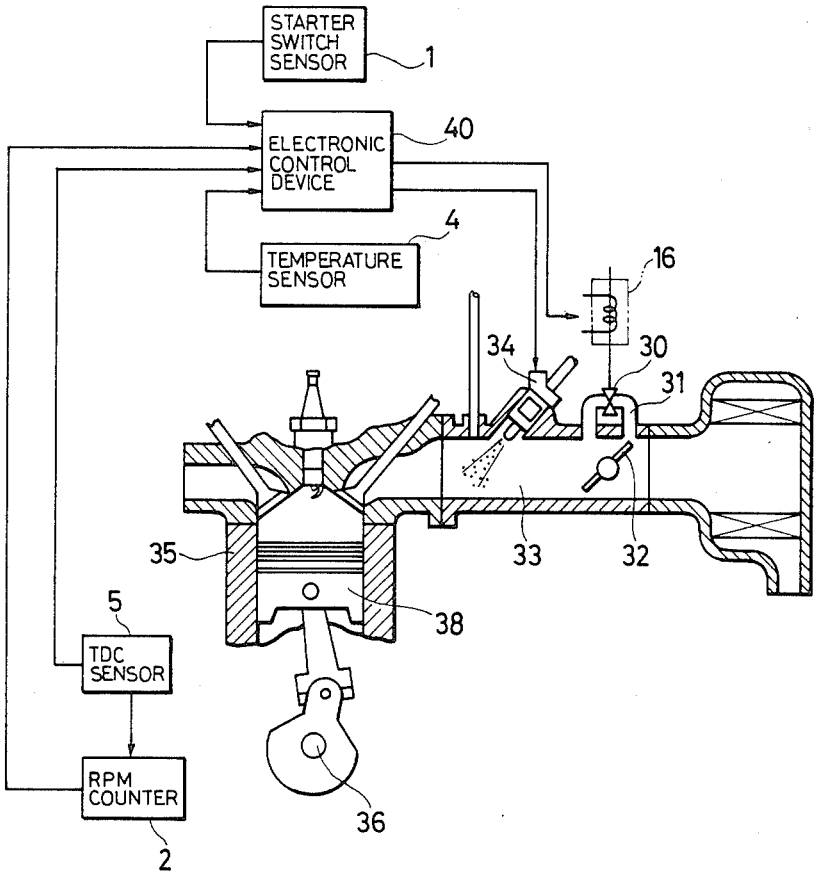
FIG. 2 is a schemetic diagram showing the basic construction of this invention.

FIG. 2 is a schematic diagram illustrating the basic construction of the present invention.

With reference to this diagram, an intake passage 33 is provided with a throttle valve 32 and a bypass 31 for bypassing the throttle valve 32. The bypass 31 has the area of its opening controlled by a control valve 30 connected to a linear solenoid 16 which adjusts the position of control valve 30 in proportion to the magnitude of electric current being supplied.

An injection nozzle 34 injects a fuel at a timing corresponding to the phase of rotation of a crank shaft 36, in an amount calculated in accordance with the operating condition of the engine, the environmental conditions such as atmospheric pressure and temperature, and the amount of inspired air into the intake passage 33, in advance by a known suitable method.

A starter switch sensor 1 detects whether a starter switch (not shown) is ON or OFF.

A TDC sensor 5 generates a pulse when the piston of each cylinder reaches 90 degrees preceding the top dead center. In other words, the TDC sensor 5 issues the same number of pulses as the cylinder number (hereinafter referred to as "TDC pulses") each time the crank shaft 36 completes two rotations.

An engine RPM counter 2 detects the number of rotations of the crank shaft 36 by clocking the intervals in the TDC pulses issued from the TDC sensor 5.

An engine temperature sensor 4 measures an engine temperature, e.g. the temperature of the cooling water.

The starter switch sensor 1, the engine RPM counter 2, the engine temperature sensor 4, and the TDC sensor 5 are connected to the input terminals of an electronic control device 40.

The electronic control device 40 has output terminals thereof connected to the injection nozzle 34 and the linear solenoid 16 and controls the magnitude of excitation of the linear solenoid 16 in accordance with the magnitudes of various statuses detected or measured by the various sensors mentioned above and by the method of calculation to be described afterward. As the result, the area of an opening of the control valve 30 is controlled.

Figure 1:
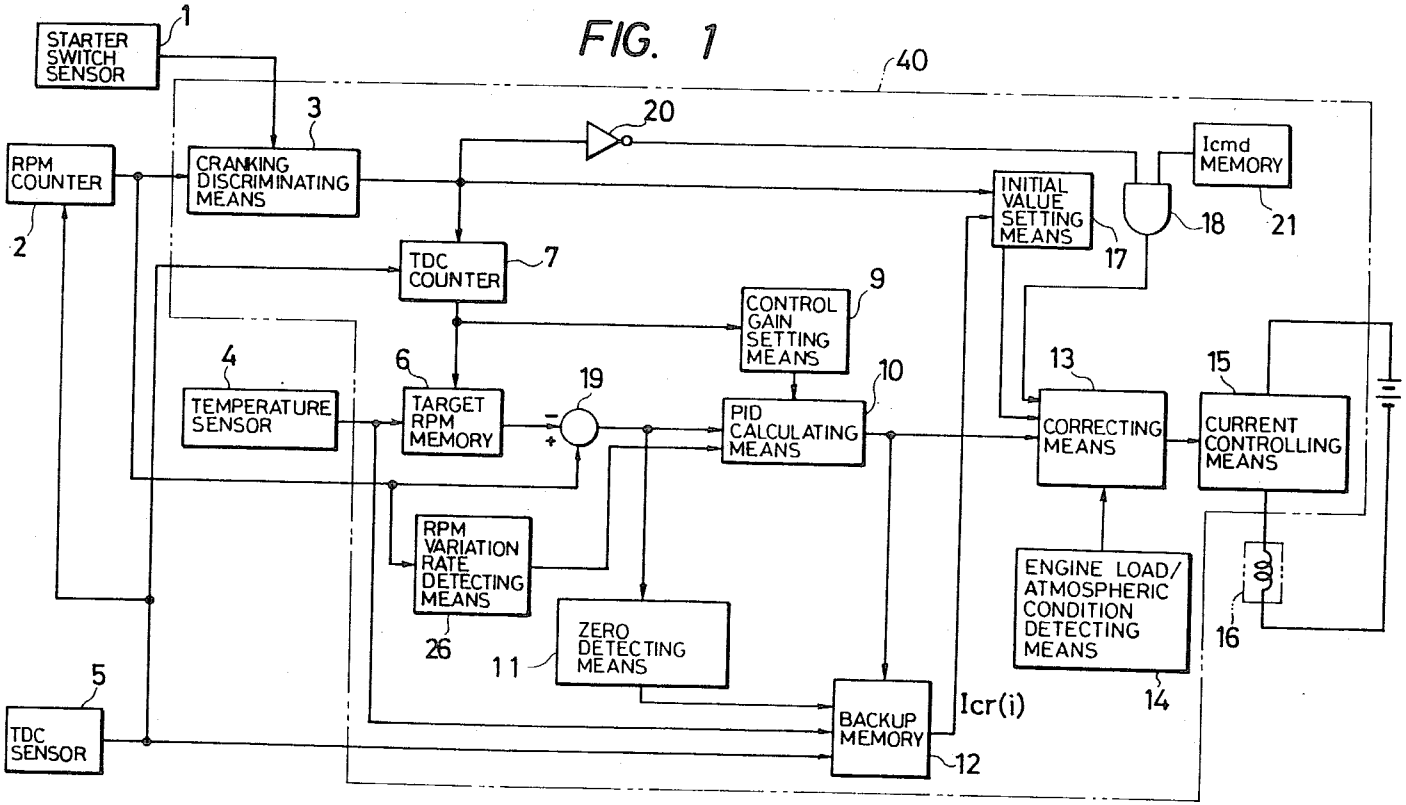
FIG. 1 is a functional block diagram illustrating a first embodiment of the present invention.

FIG. 1 is a functional block diagram of the first embodiment of this invention.

With reference to FIG. 1, outputs of the starter switch sensor 1 and the engine RPM counter 2 which counts the time intervals in the pulses issued by the TDC sensor 5 are connected to a cranking discriminator 3.

The cranking discriminator 3 determines whether the engine is during-cranking or after-cranking in accordance with the two sets of input data mentioned above and issues "0" as a during-cranking signal or "1" as an after-cranking signal to the TDC counter 7, initial value setting means 17, and an inverter 20.

In this case, the judgement of "after-cranking" can be effected, for example, when the starter switch is OFF and the number of rotations (hereinafter referred to simply as "RPM") of the crank shaft 36 reaches about $\frac{1}{2}$ of the ordinary idle RPM.

The output line of the inverter 20 and the output line of an Icmd memory 21 are connected to a pair of input terminals of an AND gate 18. An output terminal of the AND gate 18 is connected to correcting means 13. The output line of the initial value setting means 17 is also connected to the correcting means 13.

The TDC sensor 5 supplies TDC pulses to the RPM counter 2, a backup memory 12, and the TDC counter 7. The TDC counter 7 takes count of the TDC pulses issued from the TDC sensor 5 when the cranking discriminating means 3 issues an output "1", namely when the engine assumes an after-cranking status.

When the number of TDC pulses has reached the prescribed number Nacr set in advance, the TDC counter 7 issues a signal indicating this condition to a target RPM memory 6 and control gain setting means 9.

The engine temperature sensor 4 is connected to the target RPM memory 6 and the backup memory 12. In the target RPM memory 6, the target RPM, Nref (low-speed target RPM, $Nref_0$, and high-speed target RPM, $Nref_1$), defined as the function of the cooling water temperature Tw as illustrated in FIG. 3 is stored.

The high-speed target RPM, $Nref_1$, denotes a target idle RPM between the time the engine begins to rotate by itself and the time the number of TDC pulses reaches the prescribed number Nacr, for improving the condition of combustion in the after-cranking, or immediately after termination of cranking. The low-speed target RPM, $Nref_0$, denotes a target idle RPM after the number of TDC pulses has surpassed the prescribed number Nacr, namely, the idle RPM during the normal status.

Figure 3:
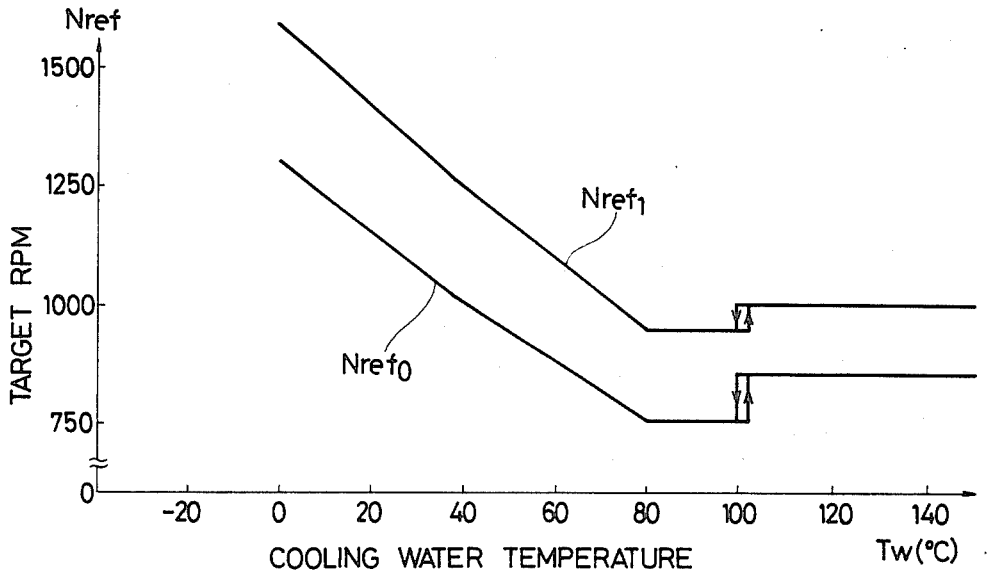
FIG. 3 is a graph showing the relation between the high-speed and low-speed target numbers of rotations and the temperature of the cooling water

From the target RPM memory 6, the high-speed target RPM, $Nref_1$ is read out until the number of TDC pulses counted by the TDC counter 7 reaches the prescribed number, Nacr or the low-speed target RPM, $Nref_0$, is read out after the number of TDC pulses has reached the prescribed number, Nacr, respectively in accordance with the cooling water temperature Tw detected by the engine temperature sensor 4 as shown to the graph of FIG. 3.

In a comparator (or subtracter) 19, the target RPM is compared with (or subtracted from) the RPM detected by the RPM counter 2. The difference consequently found is fed out to PID calculating means 10 and zero detecting means 11.

The RPM detected by the RPM counter 2 is also fed in RPM variation ratio detecting means 26, wherein the RPM variation ratio is detected. The variation ratio is fed out to the PID calculating means 10.

Figure 7:
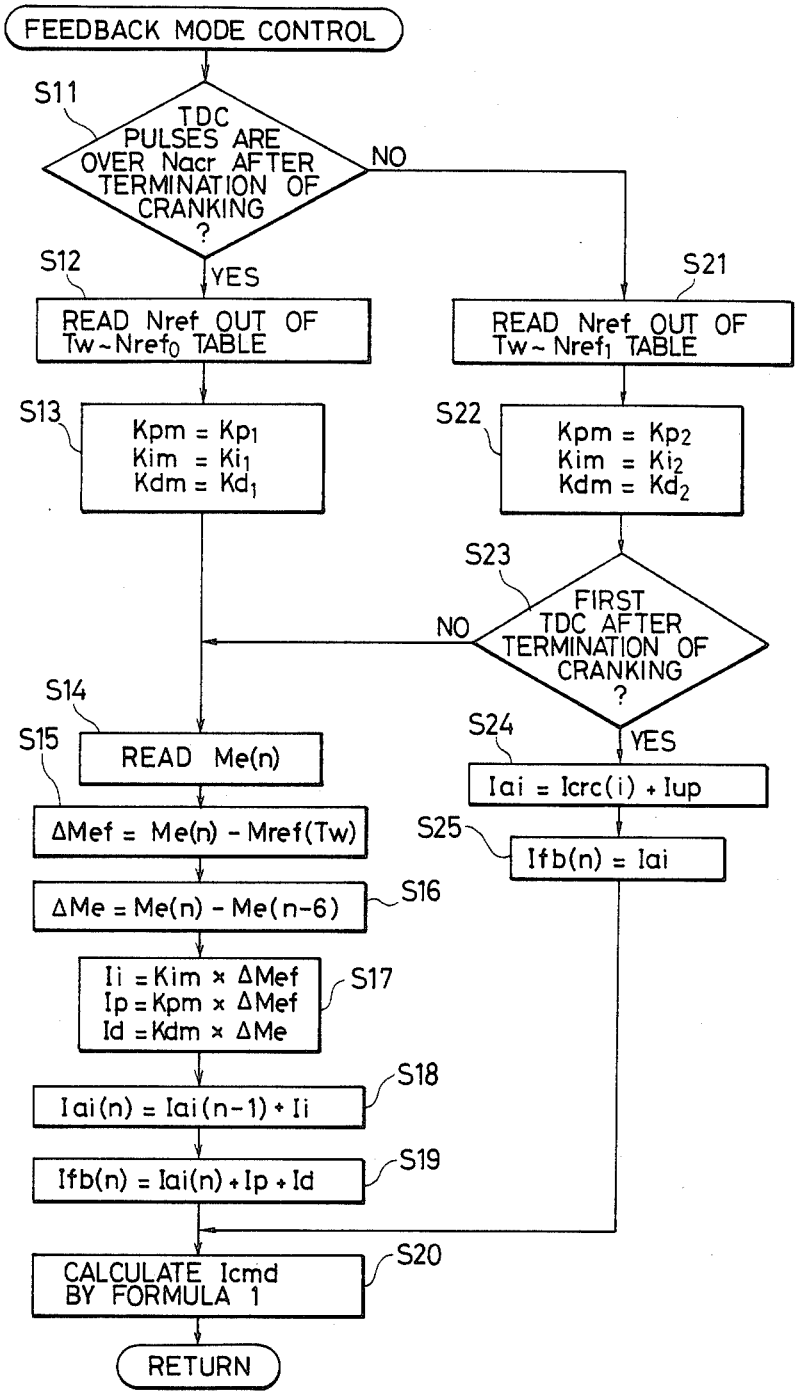
FIG. 7 is a flow chart showing a sub-routine of the feedback mode indicated in the step S5 of FIG. 6.

To effect feedback control of the magnitude of electric current to be fed to the linear solenoid 16 by the proportional plus integral plus derivative (PID) action, the calculation of a proportional term, an integration term, and a differentiation (derivation) term are calculated in the PID calculating means 10, by using the deviation and the variation ratio as described afterward with reference to FIG. 7.

Further, as described afterward with respect to the steps S13 and S22, in FIG. 7, the control gains Kpm, Kim, and Kdm respectively of the proportionation term, the integration term, and the differentiation term are each stored in advance in two forms in control gain setting means 9, and they are suitably selected, depending on whether or not the TDC counter 7 has detected the fact that the number of TDC pulses has reached the prescribed number Nacr, and fed out from the control gain setting means 9 to the PID calculating means 10.

The outcome of the calculation performed in the PID calculating means 10 is fed out to the correcting means 13 and the backup memory 12.

The deviation of the RPM fed out of the comparator 19 is further injected into the zero detecting means 11. When the deviation reaches 0, the zero detecting means 11 issues a signal indicating this fact (zero deviation signal) to the backup memory 12.

The backup memory 12, on receiving the zero deviation signal from the zero detecting means 11, learns the result of the calculation performed in the PID calculating means 10 in accordance with the engine temperature, with respect to each of the TDC pulses issued from the TDC sensor 5 and stores the result (learned value).

The backup memory 12 is further connected to the initial value setting means 17. When the output of the cranking discriminator 3 is "1," the initial value setting means 17 feeds the learned value stored in the backup memory 12 to the correcting means 13.

The correcting means 13 effects corrections corresponding to the output from the engine load/atmospheric condition detecting means 14 on the magnitude of control from the AND gate 18, the learned value issued by the backup memory 12 via the initial value setting means 17, and the result of the calculation performed in the PID calculating means 10.

The target current signal obtained by the correcting means 13 is supplied to current controlling means 15. The current controlling means 15 controls the magnitude of electric current fed to the linear solenoid 16 in accordance with the signal mentioned above.

The operation of the first embodiment of this invention constructed as described above will be described below with reference to FIG. 1, FIG. 4 and FIG. 5.

Figure 4:
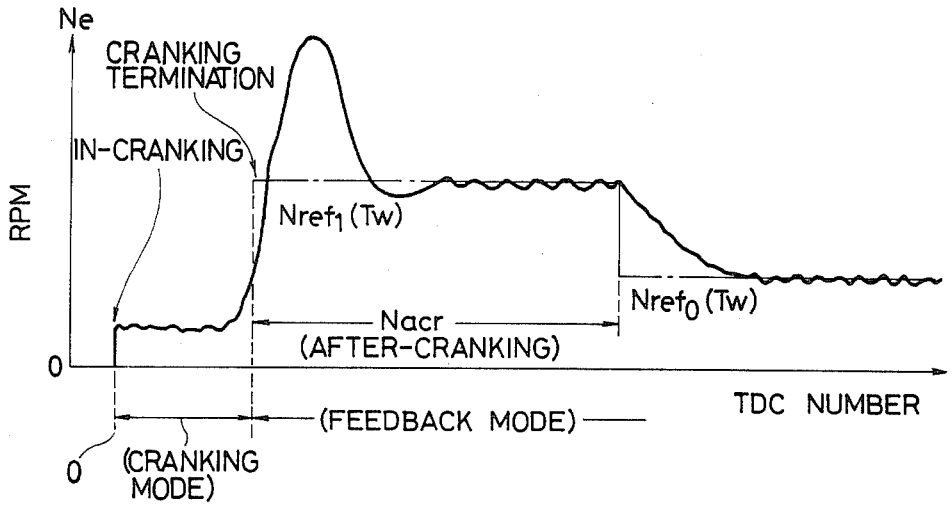
FIG. 4 is a graph showing the relation between the number of engine rotations and the number of TDC's obtained in an engine controlled in accordance with the first embodiment of this invention.
Figure 5:
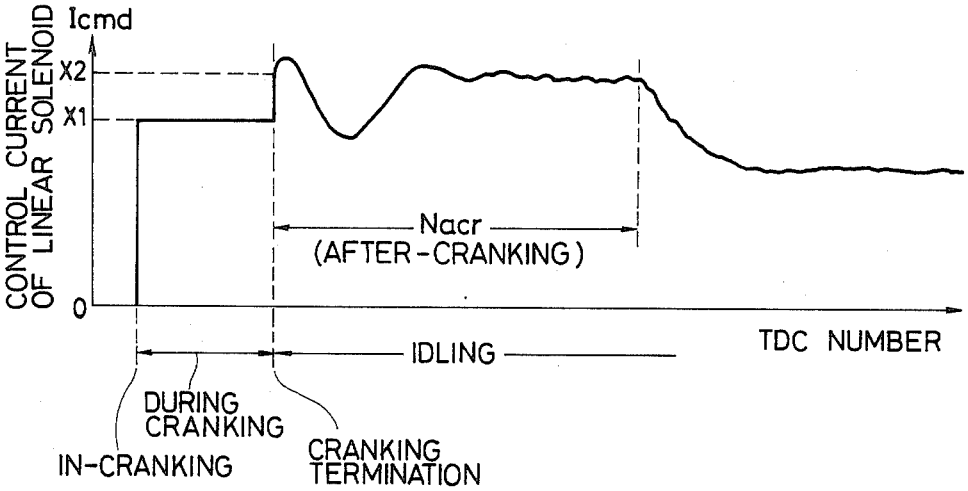
FIG. 5 is a graph showing the relation between the control current in a linear solenoid and the number of TDC's obtained in the engine controlled in accordance with the first embodiment of this invention.

FIG. 4 is a graph showing the relation between the RPM, Ne, and the number of TDC pulses counted from the start of cranking (hereinafter referred to as "TDC number") in the first embodiment of the present invention and FIG. 5 is a graph showing the relation between the control current Icmd of the linear solenoid 16 and the TDC number.

In FIG. 5, the symbol X1 denotes the value of the control current Icmd in the state of in-cranking and during-cranking and the symbol X2 denotes the value of the control current Icmd at the time that the feedback control is started in the after-cranking.

With reference to FIG. 1, when the starter switch (not shown) is turned on (namely, at the time that the cranking is started), the crank shaft is forcedly set rotating by the starter (not shown).

At the time that the cranking is started, since the output of the cranking discriminator 3 is "0," the inverter 20 issues an output "1" to open the AND gate 18. As the result, the control signal of the linear solenoid 16 stored in advance in in-cranking Icmd memory 21 is fed out to the correcting means 13.

The correcting means 13 corrects the magnitude of the control signal in accordance with the output of the engine load/atmospheric condition detecting means 14, which is indicative of the condition of load on the engine or the battery and feeds the result of the correction as the value of control current Icmd to the current controlling means 15. The current controlling means 15 controls the electric current supplied to the linear solenoid 16 with the value mentioned above.

The engine assumes an idling state when the RPM, Ne, surpasses about $\frac{1}{2}$ of the target number of idling rotations and the starter switch sensor 1 turns OFF (indicating termination of the cranking).

Figures 8, 8A:
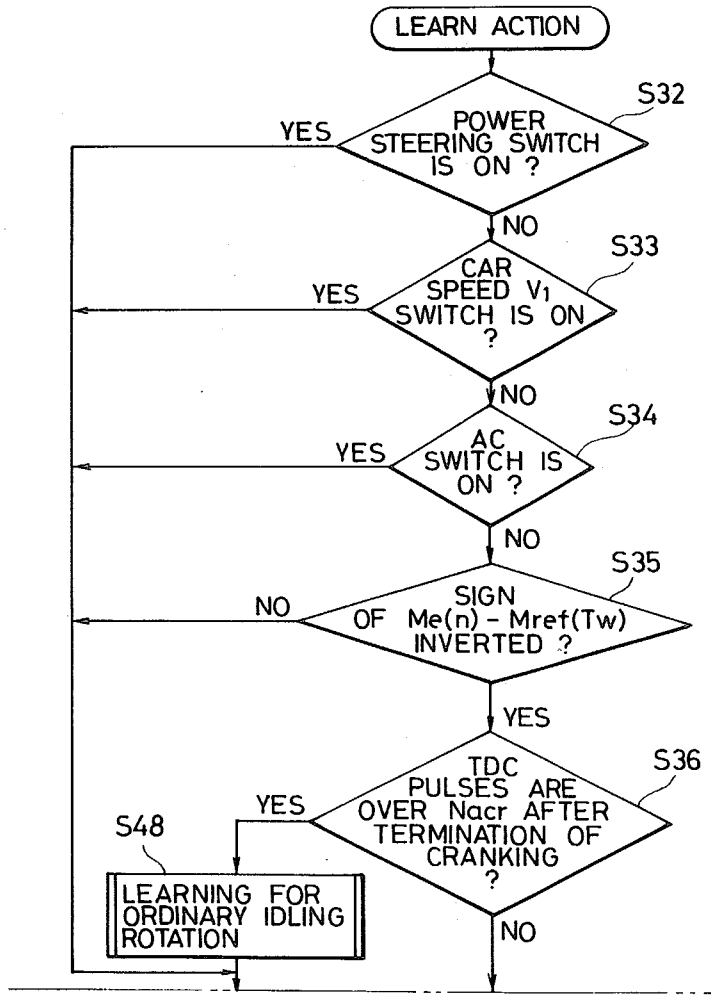
FIGS. 8, 8A and 8B show a flow chart showing a sub-routine of the learning indicated in the step S6 of FIG. 6.
Figure 8B:
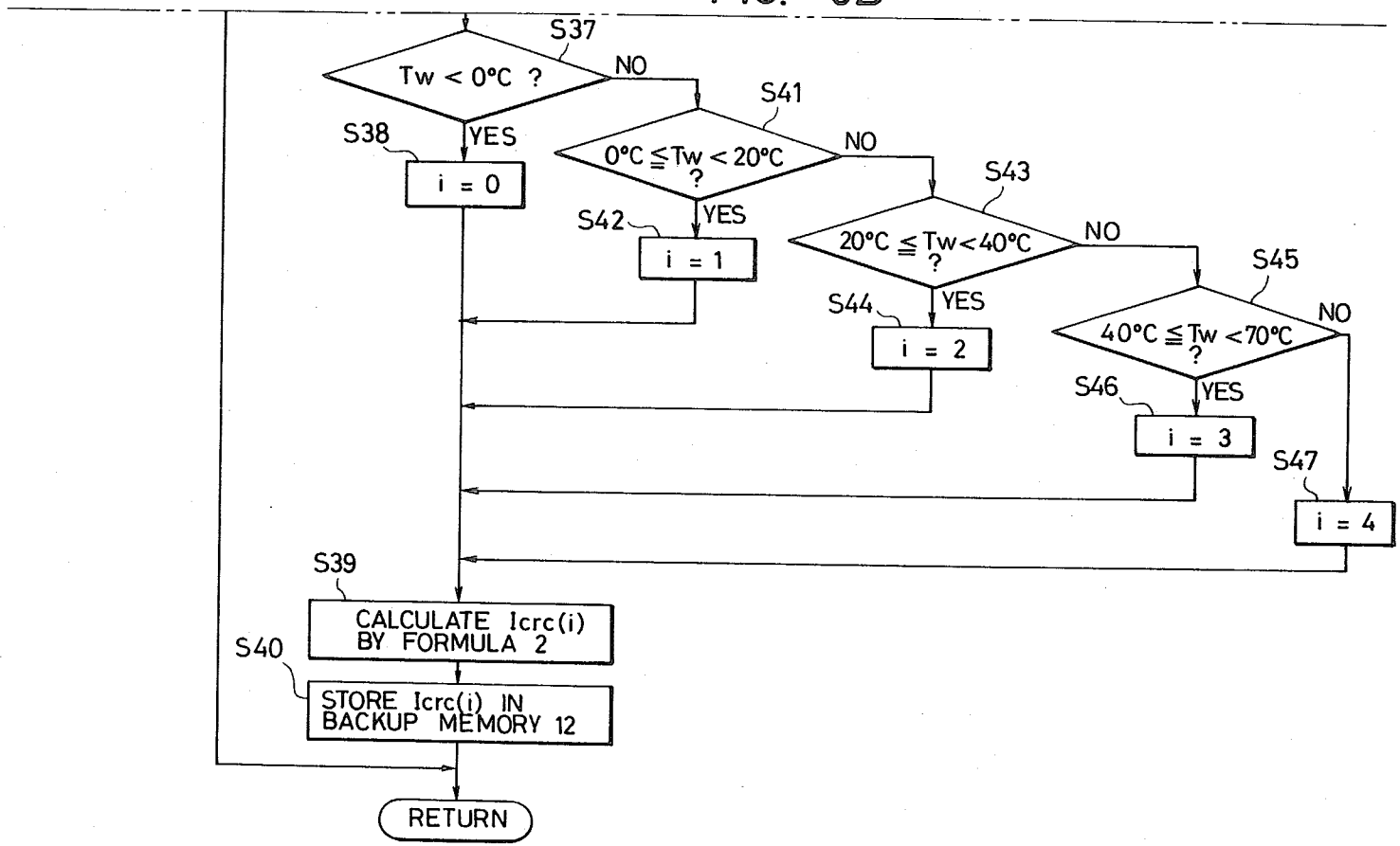

When the engine shifts from the during-cranking state to the idling state, the output of the cranking discriminator 3 turns to "1" and the learned value stored in the backup memory 12 is read out of the backup memory 12 into the initial value setting means 17 in a manner to be described afterward with respect to FIG. 8.

Consequently in the correcting means 13, the initial value of the control current Icmd of the linear solenoid during the idling period (the after-cranking period in this case) is fixed in accordance with the learned value, and the output of the engine load/atmospheric condition detecting means 14.

The initial value of the control current Icmd is issued to the current controlling means 15 and the current controlling means 15 supplies an electric current corresponding to the initial value to the linear solenoid 16 at the start of the idling operation.

In response to the output "1" of the cranking discriminator 3, the TDC counter 7 begins to take count of TDC pulses issued from the TDC sensor 5.

Before the number of TDC pulses reaches the prescribed number Nacr (FIG. 4 and FIG. 5), the high-speed target RPM, $Nref_1$ (FIG. 3) is selected out of the target RPM, Nref, for the idling period stored in the target RPM memory 6 and the high-speed target RPM, $Nref_1$ (Tw), which is fixed in accordance with the engine temperature, or the cooling water temperature Tw detected by the engine temperature sensor 4 is fed out to the comparator 19.

The comparator 19 compares the high-speed target RPM, $Nref_1$ (Tw), and the actual RPM, Ne, detected by the RPM counter 2 and finds the deviation. The PID calculating means 10 carries out necessary calculations for the PID control by using the deviation and the variation ratio of RPD detected by the RPM variation ratio detecting means 26 and issues the result of the calculations.

Then, the correcting means 13 corrects the result of calculations in accordance with the output of the engine load / atmospheric condition detecting means 14. The value of the control current Icmd of the linear solenoid is fed out to the current controlling means 15.

As the result, during the period of after-cranking between the time the cranking is terminated and the time the number of TDC pulses surpasses the prescribed number Nacr, the RPM, Ne, is controlled so as to converge to the high-speed target RPM, $Nref_1$(Tw) selected in accordance with the cooling water temperature Tw as shown in FIG. 4.

After the number of TDC pulses has reached the prescribed number Nacr, the low-speed target RPM, $Nref_0$ (FIG. 3) is selected out of the target RPM, Nref, for the idling period stored in advance in the target RPM memory 6 and the low-speed target RPM, $Nref_0$(Tw) fixed in accordance with the cooling water temperature Tw, is fed out to the comparator 19.

Again in this case, similarly to the processing effected during the period elapsing until the number of TDC pulses reaches the prescribed number, Nacr, the comparator 19 compares the low-speed target RPM, $Nref_0$(Tw), and the actual RPM, Ne, detected by the RPM sensor 2 and finds the deviation.

The PID calculating means 10 effects calculations necessary for the PID control by using the deviation and the variation rate of the RPM detected by the RPM variation rate detecting means 26.

The correcting means 13 corrects the result of the calculations in accordance with the output of the engine load/atmosphere condition detecting means 14, with the result that the command of the control current Icmd of the linear solenoid 16 will be fed out to the current controlling means 15.

After the number of TDC pulses has surpassed the prescribed number Nacr, therefore, the RPM, Ne, is controlled so as to converge to the low-speed target RPM, $Nref_0$ (Tw), selected in accordance with the cooling water temperature Tw as shown in FIG. 4.

Although FIG. 4 depicts the high-speed target RPM, $Nref_1(Tw)$ and the low-speed tatget RPM, $Nref_0(Tw)$, as always assuming fixed values in spite of variation of the number of TDC's for the sake of simplicity, it is natural that the target RPM's vary as the cooling water temperature varies with the increasing number of TDC pulses because they are functions of the cooling water temperature Tw, as shown in FIG. 3.

The PID calculating means 10 calculates the proportionation term, the integration term, and the differentiation term of the formula for the calculation of control current to effect feedback control of the control current in the linear solenoid 16.

The control gains of each of the terms mentioned above are memorized in sets each of two gains within the control gain setting means 9 to permit selection among them, depending on whether or not the number of TDC pulses has reached the prescribed number Nacr as already described.

In the first embodiment of this invention, before the number of TDC pulses reaches the prescribed number Nacr, namely while the high-speed target RPM, $Nref_1$, has been selected as a target RPM, Nref, the smaller of the two control gains is selected.

As noted from FIG. 4 and FIG. 5, immediately after termination of the cranking, the RPM, Ne, and the control current Icmd of the linear solenoid vary heavily. In this case, therefore, the first embodiment of this invention contemplates the variation to the utmost by decreasing the control gain.

After the number of TDC pulses has surpassed the prescribed number Nacr, conversely the larger of the two control gains is selected so as to enable the RPM, Ne, to converge to the target value quickly.

The initial value of the control current Icmd of the linear solenoid 16 when the engine transfers from the during-cranking state to the idling state is fixed by using the learned value stored in the backup memory 12. This learned value is admitted into the backup memory 12 only when the engine is not subject to any external load, as when the power steering switch of the automobile carrying the engine is OFF or when the shift lever of the automatic transmission is not in the D range (drive range).

When the initial value of the control current Icmd during the idling period is fixed by using the learned value and when the control current Icmd of the linear solenoid 16 is fixed by using the result of calculations in the PID calculating means 10, the correcting means 13 corrects the control currents Icmd in accordance with the engine load and the atmospheric condition detected by the engine load/atmospheric condition detecting means 14. Also when the control current Icmd in the state of in-cranking and during-cranking is fixed by using the numerical values stored in the in-cranking Icmd memory 21, the same correction is effected.

The result of the calculations performed in the PID calculating means 10 is suitably processed and memorized as the learned value in the backup memory 12 as already described. In the first embodiment of this invention, the memorization is effected when the zero detecting means 11 detects the fact that the deviation of the RPM issued from the comparator 19 turns 0 and the first TDC pulse is issued thereafter. The learned value is stored in the backup memory 12 in accordance with the cooling water temperature Tw detected by the engine temperature sensor 4 or for each of the temperature ranges.

Now, the control effected in the first embodiment of the present invention will be described below with reference to FIG. 6 to FIG. 8.

Figure 6:
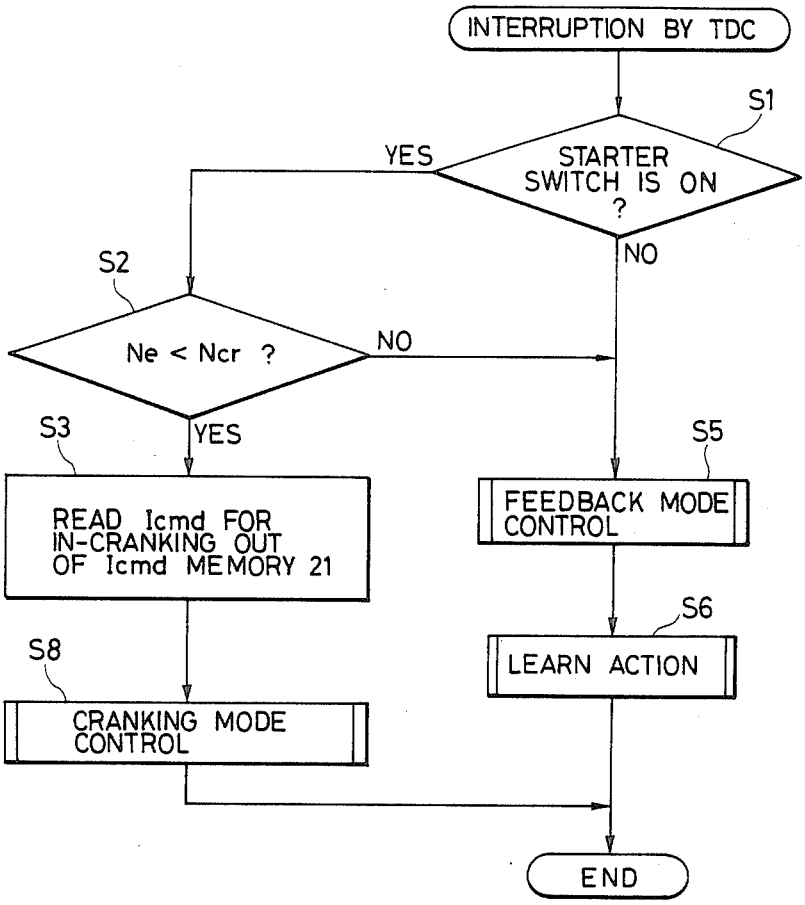
FIG. 6 is a flow chart showing the operation of control in the first embodiment of this invention.

FIG. 6 is a flow chart showing the operation of control in the first embodiment of this invention.

With reference to FIG. 6, the program is started when an interruption is effected by a TDC pulse. First in Step S1, the starter switch is checked to determine whether it is ON or not. When the start switch is ON, in Step S2 judgement is exercised to conclude whether the engine is in the during-cranking state or in the idling state, namely whether or not the RPM is less than the prescribed number Ncr.

When the RPM is less than the prescribed value, in Step S3, the values of control current Icmd in the state of in-cranking and during-cranking are read out of the in-cranking Icmd memory 21 (FIG. 1). Then, in Step S8, the electronic control device 40 (FIG. 2) assumes the cranking mode and, by a suitable known method, for example, as shown in the specification of Nagase U.S. Pat. No. 4,414,943, open loop control of the RPM, Ne, is started.

When it is judged in Step S1 that the starter switch is OFF and when it is judged in Step S2 that the RPM has surpassed the prescribed RPM, the electronic control device 40 (FIG. 2) assumes the feedback mode and the closed loop control of the RPM, Ne, is started in Step S5. The operation in Step S5 will be described afterward with reference to FIG. 7.

In Step S6, learning is effected. This learning completes the program. This operation in Step S6 will be described afterward with reference to FIG. 8.

Now, the feedback mode control in Step S5 will be described below with reference to FIG. 7.

As the feedback mode starts, in Step S11, judgement is exercised to conclude whether or not the number of TDC pulses counted after termination of the cranking has surpassed the prescribed number Nacr.

When this conclusion is negative, the high speed target RPM, $Nref_1$, is designated in Step S21 as a target RPM, Nref and, in accordance with the cooling water temperature Tw existing at that time, the high-speed target RPM, $Nref_1(Tw)$, is read out of the $Tw \sim Nref_1$ table in the target RPM memory 6 (FIG. 1).

In Step S22, the proportional term control gain Kpm, the integration term control gain Kim and the differentiation control gain, Kdm, are fixed by the control gain setting means 9 (FIG. 1).

In the control gain setting means 9, $Kp_1$ and $Kp_2$ ($Kp_1 > Kp_2$) are stored in advance as Kpm, $Ki_1$ and $Ki_2$ ($Ki_1 > Ki_2$) as Kim, and $Kd_1$ and $Kd_2$ ($Kd_1 > Kd_2$) as Kdm respectively. In Step S22, $Kp_2$, $Ki_2$ and $Kd_2$ are selected.

In Step S23, judgement is exercised to conclude whether or not the TDC pulse fed out of the TDC sensor 5 (FIG. 1) to the TDC counter 7 is the first pulse after termination of the cranking. When the conclusion is affirmative, the processing shifts to Step S24 and Step S25.

When the engine enters the feedback mode, the control current Icmd of the linear solenoid 16 is fixed by the formula for Icmd calculation (Formula 1) to be described afterward with reference to Step S20. The term Ifb(n) in the formula (1) is fixed in Step S24 and Step S25 when the feedback control is started.

Icrc(i) used in Step S24 is the learned value issued from the backup memory 12 (FIG. 1) to the initial value setting means 17. Further details on this learned value will be described afterward with respect to FIG. 8.

The learned value Icrc(i) does not always represent the best magnitude. In other words, there is a possibility that the learned value deviates more or less from the best magnitude. In Step S24, therefore, a value of correction, Iup is added to the, learned value Icrc(i). According to the addition of the value of correction Iup, the possibility of the RPM falling down immediately after the beginning of feedback control can be eliminated even when the learned value is less than the best magnitude. The value of correction Iup is a numerical value which is determined experimentally or empirically.

When the value Ifb(n) is fixed in Step S25, the processing is forwarded to Step S20, there to effect calculation of the control current Icmd of the linear solenoid 16 which is defined by the following formula.

$$Icmd=\{Ifb(n)+Ie+Ips+Iat+Iac\}\times Kpad \quad (1)$$

In the formula(1), Ie stands for the value of correction of electric load to be fixed by the magnitude of electric load connected to the battery, Ips for the value of correction of power steering to be fixed by determining whether or not the switch of the power steering has been thrown in, Iat for the value of correction of D range to be fixed by determining whether the shift lever of the automatic transmission has been thrown in, Iac for the value of correction of air conditioner to be fixed by determining whether or not the switch for the air conditioner has been turned on, and Kpad for the value of correction of atmospheric pressure to be fixed in accordance with the atmospheric pressure. And, n stands for a positive integer to be increased by 1 at a time whenever a TDC pulse is issued.

The control current of the linear solenoid 16 which is calculated in Step S20 after going through the Steps S23 through S25 is the initial value of electric current supplied to the linear solenoid 16 when the condition of engine rotation shifts from the cranking mode to the feedback mode.

The processing shifts to Step S14 when the TDC pulse counted by the TDC counter 7 (FIG. 1) is not found to be the first pulse in Step S23.

In Step S14, the reciprocal of the RPM (namely the period) detected by the RPM counter 2 (FIG. 1) or the equivalent amount Me(n) is read in.

In Step S15, the difference ΔMef between the amount Me(n) read in as described above and the reciprocal of the target RPM, Nref(Tw), [the high-speed target RPM, $Nref_1$(Tw), in this case] or the equivalent amount Mref(Tw) is calculated.

In Step S16, the difference between the amount Me(n) mentioned above and the amount Me measured in the previous round in the same cylinder as the amount Me(n) , [Me(n−6) when the engine happens to be of a 6-cylinder type], namely the variation rate of the period ΔMe is calculated.

In Step S17, the integration term Ii, the proportionation term Ip , and the differentiation term Id are calculated in accordance with the formulas of calculation indicated in the diagram by using the values, ΔMe and ΔMef, mentioned above and the control gain selected in Step S22 or Step S13 to be described afterward.

In Step S18, the integration term Ii is added to Iai(n−1) to get Iai(n). As a matter of course, the value calculated in Step S24 is used as Iai(n−1) when the processing of FIG. 7 shifts for the first time from Step S23 to Step S14.

In Step S19, the values Ip and Id calculated in Step S17 are added to Iai(n) calculated in Step S18 and the resultant sum is defined as Ifb(n).

Then, the processing shifts to Step S20 wherein the control current Icmd of the linear solenoid 16 is calculated by using the value Ifb(n) and the formula(1).

In Step S11, when it is found that the number of TDC pulses counted after termination of the cranking has surpassed the prescribed number Nacr, the processing shifts to Step S12 wherein the low-speed target RPM, $Nref_0$, is designated as the target RPM, Nref. In other words, the value, $Nref_0$(Tw) is read out of the Tw∼$Nref_0$ table in the target RPM memory 6 (FIG. 1) in accordance with the cooling water temperature existing at the time.

In Step S13, the control gain setting means 9 (FIG. 1) selects $Kp_1$, $Ki_1$ and $Kd_1$ respectively as control gains Kpm, Kim and Kdm.

Then, the processing shifts to Step S14 and the control current Icmd is calculated by the processing effected in Steps S14 through S20.

Now, the method of learning the control current Icmd of the linear solenoid 16 in Step S6 illustrated in FIG. 6 will be described with reference to FIG. 8. FIG. 8 is a flow chart showing a sub-routine for the learning.

With reference to FIG. 8, first in Steps S32 through S34, judgement is exercised to find whether or not the engine or the battery is placed under a load. To be more specific, the question whether or not the switch of the power steering is ON, the question whether or not the car speed $V_1$ switch is ON, namely whether or not the car speed has surpassed the prescribed level, and the question whether or not the AC switch (air conditioner switch) is ON are respectively decided in Steps S32, S33, and S34.

The processing of the sub-routine is completed when the engine or the battery is under load. It is forwarded to Step S35 when absolutely no load is applied on the engine or the battery.

In Step S35, the difference between the reciprocal of the RPM (cycle) detected by the RPM counter 2 (FIG. 1) or the equivalent value Me(n) and the reciprocal of the target RPM, Nref(Tw), or the equivalent value Mref(Tw), is calculated and the question whether or not the sign of the difference has been inverted is decided.

In other words, the question whether or not the curve of the RPM, Ne, and the curve of the target RPM, Nref, described in FIG. 4 have intersected each other is decided. The processing of the sub-routine is completed when the answer is in the negative. It shifts to Step S36 when the answer is in the affirmative.

In Step S36, after termination of the cranking, the question whether or not the number of TDC pulses has surpassed the prescribed number Nacr is decided. The processing shifts to Step S37 when the answer is in the negative, or when the high-speed RPM, $Nref_1$, has been selected as the target RPM, Nref. The processing shifts to Step S48 when the number of TDC pulses has surpassed the prescribed number Nacr.

The learned value Icrc(i) is calculated in Step S39 which will be described afterward, so as to serve as the reference value for decision of the initial value of the control current Icmd of the linear solenoid 16. It is classified by the range of cooling water temperature set in advance and then is stored.

Steps S37, S41, S43, and S45 form a route for the processing performed for setting the temperature ranges mentioned above. In the illustrated case, the cooling water temperature is classified into five ranges, i.e. below zero degree Centigrade, between zero and 20 degrees, between 20 and 40 degrees, between 40 and 70 degrees, and over 70 degrees Centigrade.

When the temperature range is fixed in Step S37, S41, S43, or S34, the value i for designating the temperature range is set at 0, 1, 2, 3, or 4 respectively in Step S38, S42, S44, S46, or S47.

In Step S39, the learned value Icrc(i) defined by the following formula is calculated. This value Icrc(i) is expressed as Icrc(n,i) in the following formula.

$$Icrc(n,i)=Iai(n)\times Ccrr/256+Icrc(n-1,i)\times(256-Ccrr)/256 \quad (2)$$

The term Iai(n) in the formula(2) is a numerical value calculated in Step S18 illustrated in FIG. 7 and the term Ccrr is a positive number (not more than 256) to be fixed freely. Although the particular number "256" may be freely selected, the number to be selected is desired to equal $2^n$.

When the learned value Icrc(i) corresponding to the temperature range has not yet been stored in the backup memory 12 (FIG. 1), it suffices to have a numerical value resembling the learned value stored in advance in the backup memory 12 and then to read out this numerical value as the learned value Icrc(n−1,i).

The learned value Icrc(i) calculated as described above is stored in the backup memory 12 in Step S40. Thereafter, the sub-routine is completed.

The processing is advanced to Step S48 when the number of TDC pulses has surpassed the prescribed number Nacr after termination of the cranking, namely when the low-speed target RPM, $Nref_0$, has been selected as the target RPM, Nref, in Step S36.

In Step S48, the learning for the period of ordinary idling rotation is effected by a suitable known method, for example, as shown in the specification of the aforementioned U.S. Pat. No. 4,414,943, and the sub-routine is completed.

As is clear from the description so far made, the first embodiment of this invention, when the engine assumes the state of termination of the cranking, effects closed-loop control of the control current Icmd of the linear solenoid 16 so that the RPM, Ne, will equal the target RPM, Nref(Tw), fixed in accordance with the cooling water temperature Tw.

The target RPM, Nref, exists in two forms, i.e. the high-speed target RPM, $Nref_1$, and the low-speed target RPM, $Nref_0$. The high-speed target RPM is selected between the time the engine assumes the idling state after termination of the cranking and the time the number of TDC pulses surpasses the prescribed number Nacr, namely during the after-cranking period. The low-speed target RPM is selected thereafter.

The control gain used in effecting the closed-loop control of the control current Icmd of the linear solenoid 16 also exists in two forms. The low control gain is selected while the condition of combustion in the engine is realtively unstable between the time the cranking is terminated and the time the number of TDC pulses reaches the prescribed number Nacr, so as to preclude occurrence of hunting of RPM.

Further when the RPM, Ne, perfectly or substantially equals the target RPM, Nref, and the issuance of a TDC pulse occurs after the cranking, the control current Icmd of the linear solenoid 16 is processed to obtain the learned value and is stored in accordance with the cooling water temperature existing at the time, and the learned value is used as the initial value of electric current in the idling operation for starting the engine in the next round.

As the result, the variation of the control current of the linear solenoid 16 which occurs while the engine operation shifts from the during-cranking state to the idling state is reduced and the number of idling rotations of the engine can be quickly approximated to the target RPM.

Figure 9:
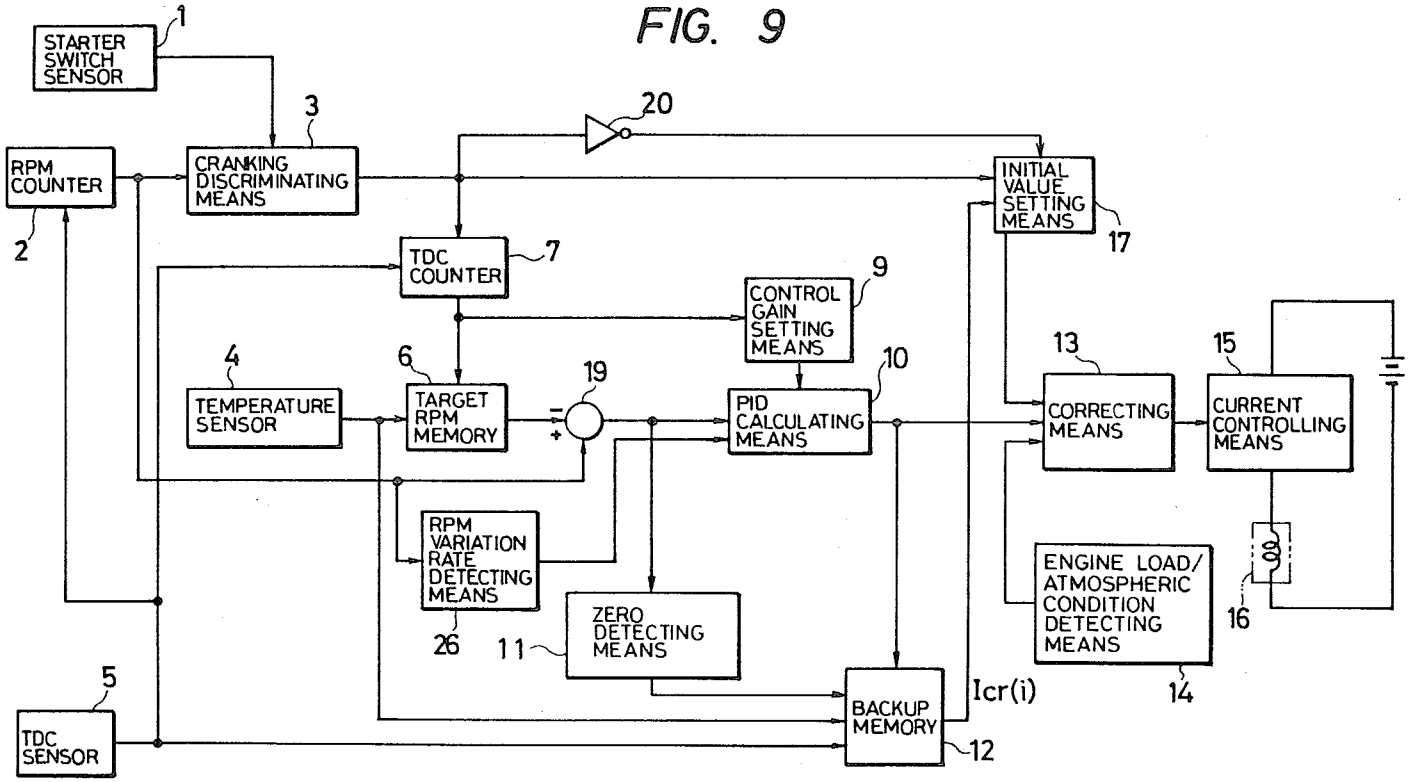
FIG. 9 is a functional block diagram illustrating the function of the second embodiment of this invention.

FIG. 9 is a functional block diagram illustrating the function of the second embodiment of this invention. In FIG. 9, the numerical symbols which have equivalents in FIG. 1 denote identical or equal parts.

The embodiment of FIG. 9, as noted clearly from comparison with that of FIG. 1, omits the AND gate 18 and the in-cranking Icmd memory 21 used in the first embodiment and has the output terminal of the inverter 20 connected to the initial value setting means 17. The characteristics of the second embodiment of this invention which is constructed as indicated above will be described below with reference to FIG. 10.

Figure 10:
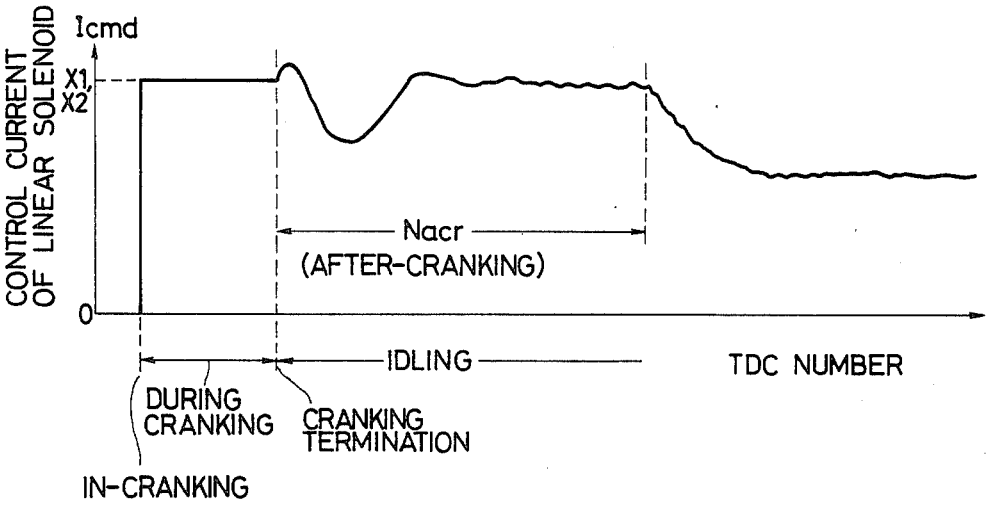
FIG. 10 is a graph-showing the relation between the control current in a linear solenoid and the number of TDC's obtained in an engine controlled in accordance with the second embodiment of this invention.

FIG. 10 is a graph showing the relation between the control current Icmd of the linear solenoid 16 and the number of TDC's in an engine controlled by the use of the second embodiment of this invention. In FIG. 10, the numerical symbols which have equivalents in FIG. 5 denote identical or equal parts.

In the first embodiment described above, as illustrated in FIG. 5, the value X1 of the control current of the linear solenoid 16 in and during the cranking is fixed based on the value read out of the in-cranking Icmd memory 21 (FIG. 1) and the initial value X2 of the control current during the idling period is fixed based on the learned value read out of the backup memory 12.

In contrast in the second embodiment of this invention, as noted clearly from FIG. 10, the values fixed based on the learned values read out of the backup memory 12 are used as the value X1 of the control current of the linear solenoid 16 in and during the cranking and the initial value X2 of the control current during the idling period.

In the second embodiment, therefore, the variation of the control current Icmd of the linear solenoid 16 during the transfer from the in-cranking state to the after-cranking state is smaller than that of the first embodiment and, as the result, the RPM, Ne, can be approximated more quickly to the target RPM.

Figure 11:
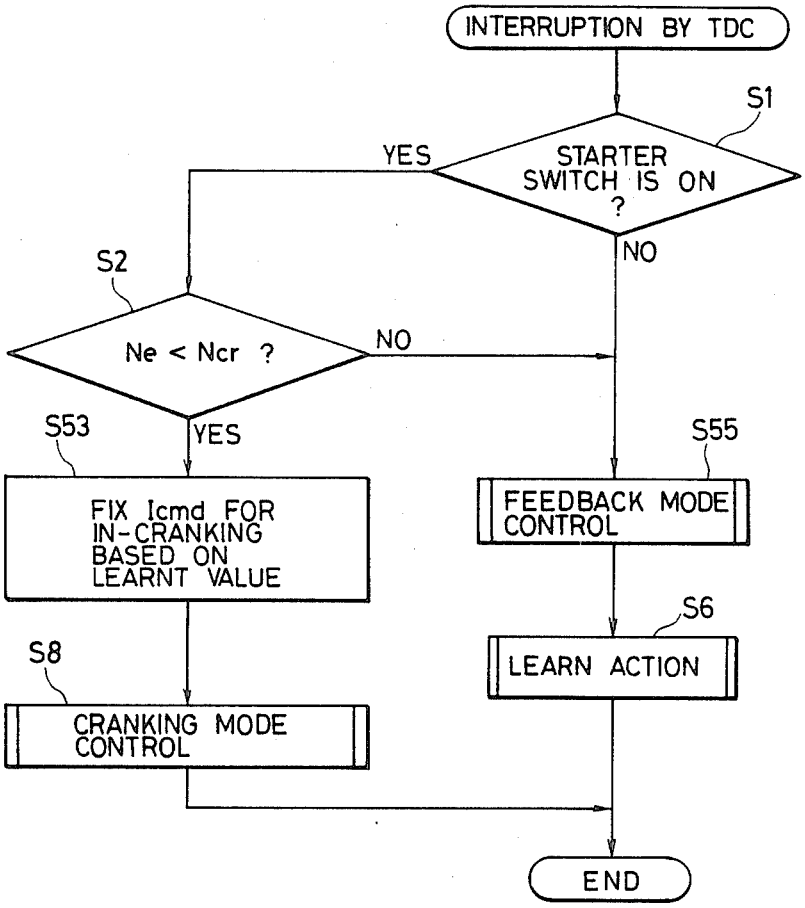
FIG. 11 is a flow chart showing the operation of control in the second embodiment of this invention.

FIG. 11 is a flow chart showing the operation of control in the second embodiment of this invention. In FIG. 11, the numerical symbols which have equivalents in FIG. 6 denote identical or equal parts. Thus, the explanation of these parts are omitted here.

With reference to FIG. 11, first in Step S1, judgement is exercised to find whether or not the starter switch is ON. When the answer is in the affirmative, then in Step S2, judgement is exercised to find whether the engine is in the in-cranking state or in the idling state, namely whether or not the RPM is less than the prescribed RPM, Ncr. When the RPM is less than Ncr (when the engine is in the in-cranking state), in Step S53, the control current Icmd of the linear solenoid 16 between the time the engine is started and the time the idling operation is started is fixed.

The control current is calculated in accordance with the following formula, based on the learned value Icrc(i) read out of the backup memory 12.

$$Icmd=\{Icrc(i)+Iup+Ie+Ips+Iat+Iac\}\times Kpad \quad (3)$$

Step S55, similarly to Step S5 shown in FIG. 6, is a subroutine having substantially the same contents as the subroutine shown in FIG. 7. The details of Step S55 are illustrated in FIG. 12.

Figure 12:
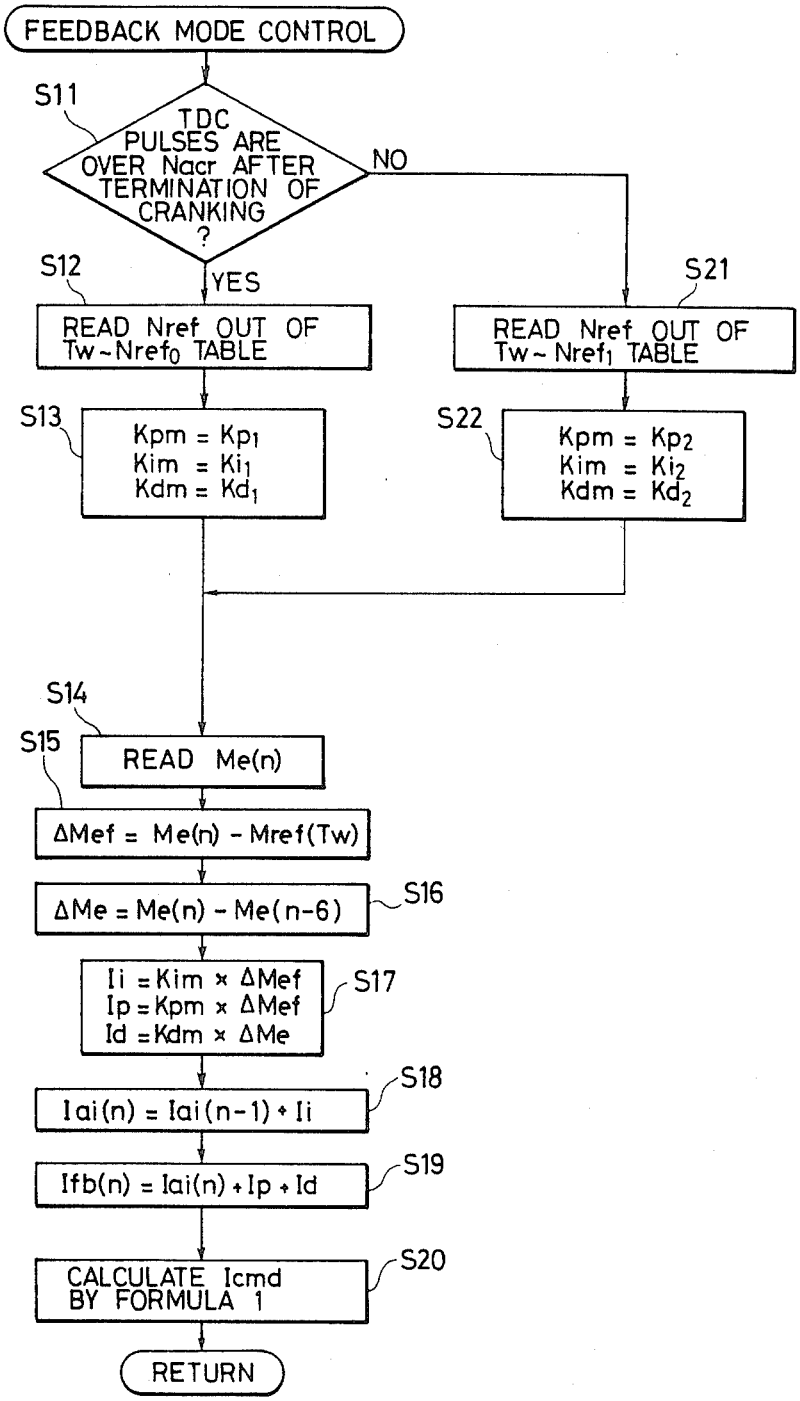
FIG. 12 is a flow chart showing a sub-routine of the feedback mode indicated in the step S55 of FIG. 11.

As clearly noted from comparison of FIG. 12 with FIG. 7, the subroutine of feedback mode represented as Step S55 equals that of the flow chart of FIG. 7, except that Steps S23 through S25 are eliminated and the processing of Step S14 is executed immediately after that of Step S22. Any further explanation of FIG. 12 will be superfluous to persons of ordinary skill in the art.

Figure 13:
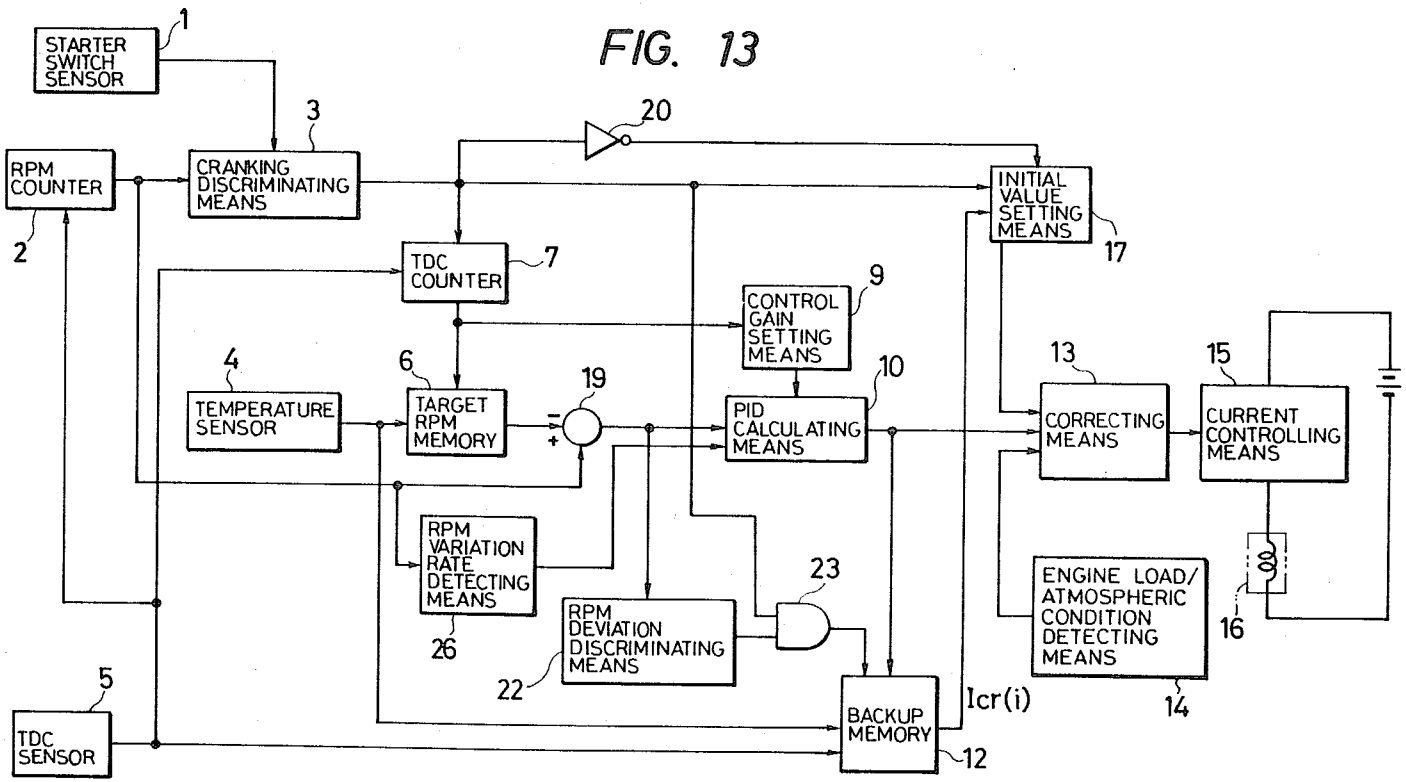
FIG. 13 is a functional block diagram showing the third embodiment of this invention.

FIG. 13 is a functional block diagram illustrating the function of the third embodiment of this invention. In FIG. 13, the numerical symbols which have equivalents in FIG. 9 denote identical or equal parts.

The third embodiment of the present invention is a modified version of the second embodiment thereof.

In the layout of FIG. 13, RPM deviation discriminating means 22 and an AND gate 23 are disposed in place of the zero detecting means 11 shown in FIG. 9. To one of the two input terminals of the AND gate 23 is connected the output line of the cranking discriminating means 3. To the other input terminal thereof is connected the output line of the RPM deviation discriminating means 22. The output terminal of the AND gate 23 is connected to the backup memory 12.

The RPM deviation discriminating means 22 is a device for detecting the fact that the deviation of the RPM, Ne, from the target RPM, Nref(Tw) , has changed from a positive to a negative value. To the input terminal of this means 22 is connected the output terminal of the comparator 19. To be more specific, the RPM deviation discriminating means 22 serves to find the fact that, during the after-cranking in the flow chart of FIG. 4, the RPM, Ne, has once surpassed the target RPM, Nref, and then fallen thereunder.

After the output of the AND gate 23 turns to "1", namely after the cranking discriminating means 3 finds that the engine has entered the idling state and the RPM deviation discriminating means 22 finds that the RPM, Ne, has once surpassed the target RPM, Nref, and then fallen thereunder, the backup memory 12 admits the outcome of calculations performed in the PID calculating means 10 and calculates and stores the learned value each time the TDC sensor 5 issues a TDC pulse.

Figures 14, 14A:
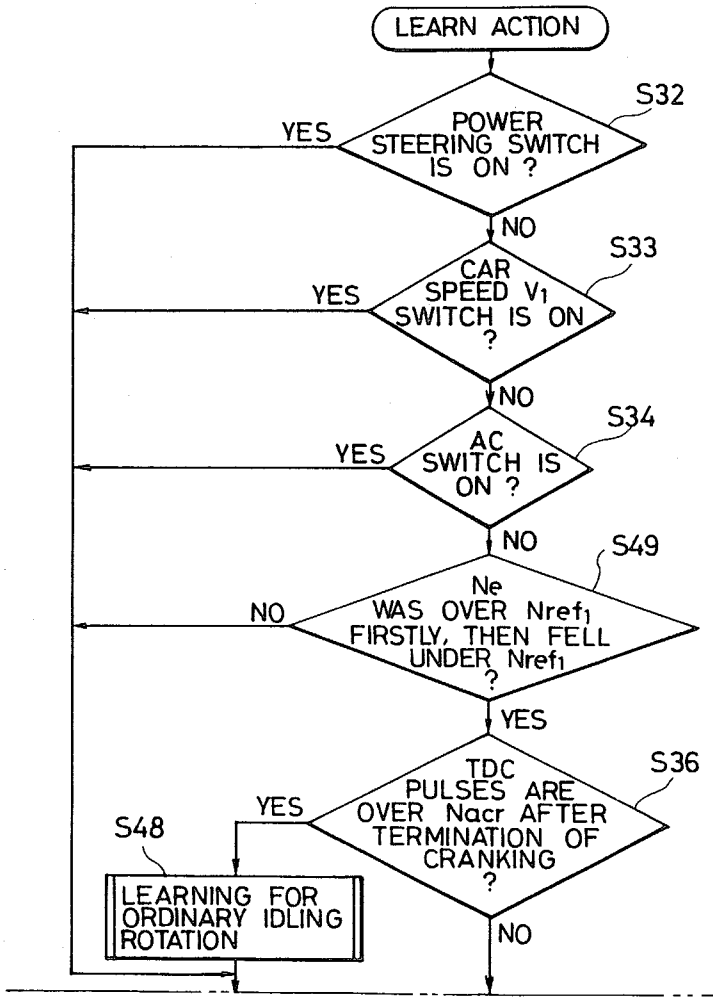
FIGS. 14, 14A and 14B show a flow chart showing the operation of learning in the third embodiment of this invention.
Figure 14B:
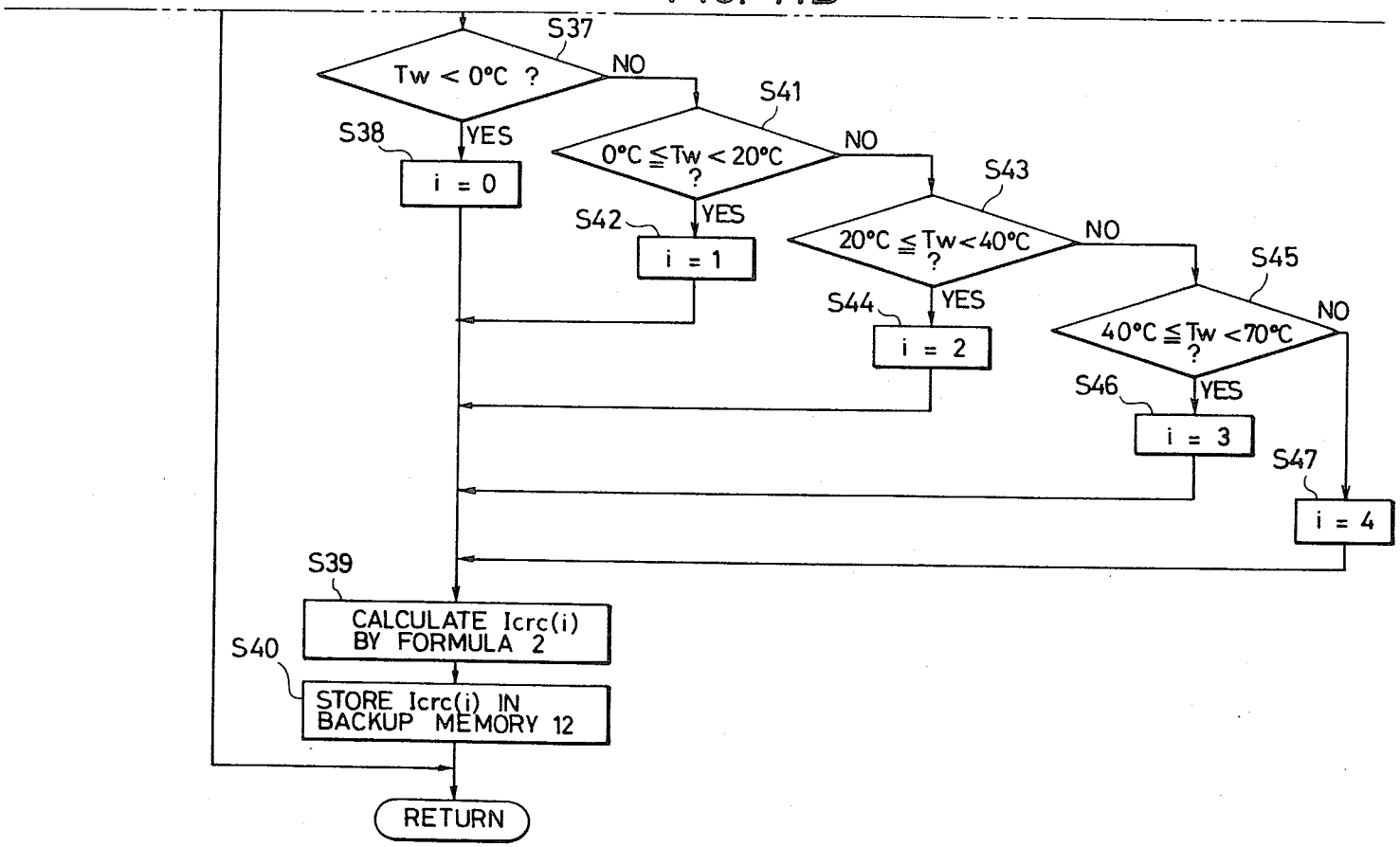

The operation during the period of this learning will be described below with reference to FIG. 14. FIG. 14 is a flow chart illustrating the operation of learning in the third embodiment of this invention. In FIG. 14, the numerical symbols which have equivalents in FIG. 8 denote identical or equal parts. The explanation of these parts will be omitted.

First, in Steps S32 through S34, the processing shifts to Step S49 when it is confirmed that no load is applied on the engine or the battery.

In Step S49, judgement is exercised to find whether or not the RPM, Ne, has surpassed the high-speed target RPM, $Nref_1(Tw)$ , for the first time and then fallen under the high-speed target RPM. When the answer is in the affirmative, the processing sifts to Step S36, wherein the learned value Icrc(i) is calculated and stored in the same manner as described above.

The embodiments of this invention described above can be modified as follows.

(1) The various control gains described above may be in one form each.

(2) The embodiments have been described as effecting the feedback control by the PID operation during the processing of feedback mode. The PID operation is not necessarily an indispensable requirement for this invention. This invention can rely for the feedback control instead upon at least one of the P operation, I operation, and D operation.

(3) The learned value Icrc(i) has been described as being calculated in accordance with the formula(2). The formula(2)is not necessarily the only source of the calculation. By the formula (2), the learned value Icrc(n,i) is calculated by adding the terms Iai(n) and Icrc(n−1,i) in a prescribed ratio. It may be obtained instead by causing the values of Iai in the last several rounds to be stored and finding their average.

It is clearly noted from the description given above, that this invention attains the following effects.

(1) Since the control current of the linear solenoid regulating an opening area in the bypass of the throttle valve is controlled in the feedback mode such that the RPM after the cranking coincides with the high-speed target RPM fixed in accordance with the cooling water temperature, the RPM can be always maintained at the optimum level without being affected by differences or variations in the viscosity characteristics of the engine oil, the cooling water temperature, the temperature of the ambient air, the atmospheric pressure, etc.

As a result, hunting of the engine speed of rotation and the wasteful consumption of fuel can be precluded.

(2) The initial value of the control current of the linear solenoid 16 in the beginning of an idling operation, namely the initial value during the transfer from the during-cranking state to the after-cranking state at least in the subsequent starting of engine, is fixed based on the learned value which has been obtained by learning the control current of the linear solenoid in the after-cranking state. The variation of the control current of the linear solenoid, namely the variation of the RPM, during the transfer of the engine operation from the during-cranking state to the state of idling operation can be suppressed to the fullest possible extent.

What is claimed is:

1. An apparatus for the control of the number of idling rotations of an internal combustion engine provided with a control valve for adjusting an amount of an inspired air to said engine, control valve drive means for driving said control valve, and control means for supplying a control signal to said control valve drive means, said control means comprising:

internal combustion engine RPM detecting means for detecting the number of rotations for said internal combustion engine, cranking discriminating means for determining whether or not said internal combustion engine is in the state of during-cranking, after-cranking discriminating means operatively connected to said cranking discriminating means for determining whether said internal combustion engine is in an after-cranking state during a predetermined period of time following termination of the during-cranking state, or whether it is in an after-cranking state following elapse of said predetermined period of time, target RPM memorizing means for storing a target RPM of said internal combustion engine, deviation detecting means for reading out said target RPM of said target RPM memorizing means after the termination of the cranking state and detecting the deviation of said detected RPM of said internal combustion engine from said target RPM, control gain generating means operatively connected to said cranking discriminating means for generating different control gains in response to the determination made by said after-cranking discriminating means, and control signal output means operatively connected to said deviation detecting means and to said control gain generating means for supplying a control signal in said control gain to said control valve drive means in accordance with said deviation.

2. An apparatus according to claim 1, wherein said target RPM is fixed in advance as the function of the temperature of said internal combustion engine at the time that said target RPM is read out.

3. An apparatus according to claim 1, wherein said target RPM during the after-cranking state is fixed at a level higher than a target RPM during the idling operation after elapse of said predetermined period of time from the termination of the cranking state.

4. An apparatus according to claim 1, wherein said deviation detecting means effects the detection of said deviation each time a TDC pulse is issued.

5. An apparatus according to claim 1, wherein said control gain is initially smaller than the control gain obtained during the idling operation after termination of the cranking state.

6. An apparatus according to claim 1 wherein said predetermined period of time after the termination of the cranking state is based on the number of TDC pulses.

7. An apparatus for the control of the number of idling rotations of an internal combustion engine provided with a ocntrol valve for adjusting an amount of an inspired air to said engine, control valve drive means for driving said control valve, and control means for supplying a control signal to said control valve drive means, said control means comprisng:

internal combustion engine RPM detecting means for detecting the number of rotations of said internal combustion engine, cranking discriminating means for determining whether said internal combustion engine is in a during-cranking state or in an after-cranking state, after-cranking discriminating means operatively connected to said cranking discriminating means for determining whether said internal combustion engine is in an after-cranking state during a predetermined period of time following termination of said cranking state, or whether it is in an after-cranking state following elapse of said predetermined period of time, target RPM memorizing means operatively connected to said after-cranking discriminating means for storing a target RPM of said internal combustion engine corresponding to an output signal from said after-cranking discriminating means, deviation detecting means for reading out said target RPM of said target RPM memorizing means after the termination of the cranking state and detecting the deviation of said detected RPM of said internal oombustion engine from said target RPM, control signal output means operatively connected to said deviation detecting means for supplying a control signal in a prescribed control gain to said control valve drive means in accordance with said deviation, and learned value calculating and memorizing means operatively connected to said deviation detecting means and to said after-cranking discriminating means for calculating learned values based on said deviation for said predetermined period of time following termination of said cranking state, and for the after-cranking state following elapse of said perdetermined period of time, and storing the said learned values.

8. An apparatus according to claim 7 wherein the initial value of said control signal after the cranking state is calculated based on one of said learned values stored in said learned value calculating and memorizing means.

9. An apparatus according to claim 7, wherein said control signal in the in-cranking and during-cranking states is calculated based on a learned value stored in said learned value calculating and memorizing means.

10. An apparatus according to claim 7, wherein said learned value calculating and memorizing means calculates and stores said learned values when said deviation is substantially equal to zero.

11. An apparatus according to claim 7, wherein said learned value calculating and memorizing means starts calculating and storing said learned values at the time that said internal combustion engine enters the after-cranking state and the RPM of said internal combustion engine has surpassed said target RPM for the first time and then fallen below said target RPM.

12. An apparatus according to claim 7, wherein said learned value calculating and memorizing means stores the calculated learned values in accordance with the temperature of said internal combustion engine at the time of detection of said deviation.

13. An apparatus according to claim 7 wherein said predetermined period of time after the termination of the cranking state is based on the number of TDC pulses.

* * * * *